US008764508B1

(12) United States Patent
Eckard et al.

(10) Patent No.: US 8,764,508 B1
(45) Date of Patent: Jul. 1, 2014

(54) CUSTOMIZABLE LOCKING MAGNETIC PLAY SET

(71) Applicant: Hermosa Beach Concepts LLC, Castro Valley, CA (US)

(72) Inventors: Sean Eckard, New York, NY (US); Mark Etchin, West Lebanon, NH (US)

(73) Assignee: Hermosa Beach Concepts LLC, Castro Valley, CA (US)

( * ) Notice: Subject to any disclaimer, the term of this patent is extended or adjusted under 35 U.S.C. 154(b) by 0 days.

(21) Appl. No.: 14/205,293

(22) Filed: Mar. 11, 2014

(51) Int. Cl.
*A63H 33/26* (2006.01)
*A63H 3/36* (2006.01)

(52) U.S. Cl.
CPC ..... *A63H 3/36* (2013.01)
USPC ..... 446/137

(58) Field of Classification Search
USPC ..... 434/81, 96, 97; 446/92, 98, 129, 137, 446/139
See application file for complete search history.

(56) References Cited

U.S. PATENT DOCUMENTS

| | | | | |
|---|---|---|---|---|
| 3,928,921 | A * | 12/1975 | Gurman | 434/428 |
| 5,079,058 | A * | 1/1992 | Tomiyama et al. | 428/41.2 |
| 5,178,573 | A | 1/1993 | Smith | |
| 5,203,847 | A * | 4/1993 | Butt | 273/157 R |
| 5,452,508 | A * | 9/1995 | Wu | 29/428 |
| 5,666,712 | A * | 9/1997 | Cvetkov | 29/458 |
| 6,312,795 | B1 | 11/2001 | Yamamoto | |
| 6,790,117 | B2 | 9/2004 | Ruiz Gonzalez | |
| 7,192,628 | B2 * | 3/2007 | Burrows | 427/598 |
| 2010/0159793 | A1 | 6/2010 | Pittenturf et al. | |

* cited by examiner

*Primary Examiner* — Kurt Fernstrom
(74) *Attorney, Agent, or Firm* — Kevin Keener; Keener and Associates P.C.

(57) ABSTRACT

The invention is directed toward a stackable magnetic toy set. The toy set comprises a plurality of planar magnetic design sheets and a magnetic base sheet. The planar magnetic design sheets are comprised of a bottom layer of magnetic foil, a middle layer of an acrylic elastomer, and a top layer of a printable thermoplastic. The planar magnetic design sheets consist of a series of alternating strips of polarity. The planar magnetic design sheets are stacked together on top of the magnetic base sheet to create a predetermined design. The plurality of planar magnetic design sheets are combined edge to edge to create a predetermined design. The planar magnetic design sheets may be in the appearance of human figures and human figure accessories. The toy set may further comprise a plurality of coloring instruments to allow a user to customize the design on the magnetic design sheets.

20 Claims, 8 Drawing Sheets

CUSTOMIZABLE LOCKING MAGNETIC PLAY SET

FIELD OF THE INVENTION

The invention relates generally to magnetic toys and puzzles and more specifically to a customizable magnetic toy set, the set featuring a magnetic base sheet and a plurality of magnetic design sheets. The magnetic design sheets may take the form of a plurality of dolls and a plurality of doll accessories, all composed of a flexible rubber embedded with rows of magnetic elements thereby allowing the dolls and doll accessories to lock into proper position.

BACKGROUND OF THE INVENTION

Children like to play with puzzles and toys. Historically, puzzles have been made out of cardboard or paper. Puzzles are normally made in a single plane where all pieces fit together to make a final picture. Three dimensional puzzles are known where shaped pieces fit together vertically and horizontally to form a complete three dimensional shape such as a sphere or a building. However, the prior art does not disclose a three dimensional puzzle where multiple planes fit together to form a complete predetermined image. In addition, puzzles are not meant to be colored or drawn on by users. What is needed is a puzzle that permits a child to color and draw on top of the image that is created when the pieces fit together. In addition, standard puzzles are limited in that puzzles must be completed on a horizontal surface. Also, pieces can be dropped and lost when putting the puzzle together. What is needed is a puzzle which may be put together and displays on a vertical surface and where the puzzle pieces are not easily dropped because they are magnetic and adhere to a specific location.

In the preferred embodiment of the invention, the puzzle pieces closely resemble human figures, such as paper dolls. Children have played with paper dolls throughout history. Normally a child will cut out a human shape out of paper and color or draw a human figure on the piece of cut out paper, forming a paper doll. The child will then color or draw accessories for this paper doll on other pieces of paper. The child then cuts out these accessories and places them on the paper doll. Normally a child will color clothing items for the paper doll. The child then cuts out the clothing item for the paper doll with fold over tabs. These tabs fold over the edge of the paper doll and hold the paper clothing onto the paper doll. A child may then draw new clothing items, cut them out, and then easily exchange them with the originally drawn paper clothing items. This type of play provides hours of entertainment to children.

Although well known, the historical method is limited. Paper cannot be reused once it has been cut and colored. Improvements to the standard historical method are also known. U.S. Pat. No. 5,178,573 (Smith) discloses and claims a magnetic doll accessory kit that utilizes magnetic dolls covered with paper and a steel backing sheet. This patent is limited in that the planar magnetic accessories would not lock into place when placed on the paper doll but could be placed in any position, or could slide around after being placed in the proper position. U.S. Pat. No. 6,790,117 (Gonzalez) teaches a paper doll with a plurality of miniature magnets at specific points. While such a system would allow the doll accessories to lock into place, the system is limited in that these specific magnets must be carefully placed during the manufacturing process or the magnets may fall out of the paper doll during use. Thus this system may easily fail.

In addition, it is often desirable to customize these paper dolls and accessories. Magnetic paper dolls are often bought with images and colors already present on the material without any manner to change the appearance of any one piece of the set. U.S. Patent Application Publication No. 2010/0159793 (Pittendurf et al.) teaches a customizable magnetic paper doll set where a user prints out pictures on paper and adheres them to a magnetic backing. Such customization is limited though in that the paper may easily become detached from the magnetic backing.

What is needed is a magnetic puzzle in which the pieces lock into place and in which the images appearing on the pieces can be customized by coloring the parts, wiping them clean, and then coloring them again, or by printing desirable designs directly onto the magnetic backing by means of a personal printer.

SUMMARY OF THE INVENTION

The invention is directed toward a magnetic play set. The invention is directed toward a stackable magnetic toy set comprising a plurality of planar magnetic design sheets and a magnetic base sheet. Each of the planar magnetic design sheets are comprised of a bottom layer of magnetic foil, a middle layer of an acrylic elastomer, and a top layer of a printable thermoplastic. The planar magnetic design sheets are anisotropic magnets consisting of a series of alternating strips of polarity. The alternating strips of polarity of one planar magnetic design sheet are structured to magnetically attach to the alternating strips of polarity of a complementary planar magnetic design sheet. The planar magnetic design sheet and the complementary magnetic design sheet form a predetermined image when magnetically adhered together. The magnetic base sheet is comprised of a thermoplastic bonded metallic foil. The plurality of planar magnetic design sheets are stacked together on top of the magnetic base sheet to create a predetermined design. The plurality of planar magnetic design sheets are combined edge to edge to create a predetermined design.

Furthermore, the bottom layer of the planar magnetic design sheets may be composed of a mixture of strontium and barium ferrites, the top layer of the planar magnetic design sheets may be polyvinyl chloride, and the middle layer of the planar magnetic design sheets may be synthetic rubber. Furthermore, the planar magnetic design sheets may be from 0.4 mm to 0.6 mm thick and the base sheet may be from 0.4 mm to 0.6 mm thick. Furthermore, the base sheet may be constructed from a magnetic powder mixed with polymers. In this instance the magnetic base sheet is an isotropic magnet. Furthermore, in this embodiment of the invention, the planar magnetic design sheets have an intrinsic coercivity of 3100 Oe to 3600 Oe, a coercivity of 1900 Oe to 2200 Oe, a remanence of 2100 to 2600, a maximum energy product of 1.10 MGOe to 1.30 MGOe, and a magnetic pull force of 42 Newtons. Furthermore, the magnetic powders in the base sheet may be a mixture of strontium and barium ferrite.

This embodiment may further comprise a plurality of coloring instruments. The surface of the planar magnetic designs may be colored with the coloring instruments to enhance the design on the surface of the planar magnetic design sheets. In this embodiment, the coloring instruments may be washable crayons, washable markers, or paint brushes with a plurality of water-based paints. In this embodiment the planar magnetic design sheets may consist of human figure designs and human figure accessory designs. The planar magnetic design sheets of human figure accessory designs magnetically adhere in a predetermined location on the planar magnetic design sheets of human figure designs to create a predetermined design. The magnetic base sheet has a background image complementing the planar magnetic design sheets of human figure designs. The base sheet may further comprise a peel and stick back. In this embodiment, the base sheet has a pre-applied adhesive on the back of the base sheet permitting a user to removably adhere the base sheet to a vertical surface area. Furthermore, the planar magnetic design sheets and the base sheet are designed to permit a user to place the planar magnetic design sheets in a printer to print a personal design on the planar magnetic design sheets or base sheet.

In an alternative embodiment of the invention, the invention is directed toward a stackable magnetic toy set comprising a plurality of planar magnetic design sheets and a magnetic base sheet. Each of the planar magnetic design sheets are comprised of a bottom layer of magnetic foil, a middle layer of an acrylic elastomer, and a top layer of a printable thermoplastic. The planar magnetic design sheets are anisotropic magnets consisting of a series of alternating strips of polarity. The alternating strips of polarity of one planar magnetic design sheet are structured to magnetically attach to the alternating strips of polarity of a complementary planar magnetic design sheet. The planar magnetic design sheet and the complementary magnetic design sheet form a predetermined image when magnetically adhered together. The magnetic base sheet is comprised of a thermoplastic bonded metallic foil. The plurality of planar magnetic design sheets are stacked together on top of the magnetic base sheet to create a predetermined design. The plurality of planar magnetic design sheets are combined edge to edge to create a predetermined design. The planar magnetic design sheets in this alternative embodiment consist of human figure designs and human figure accessory designs. The planar magnetic design sheets of human figure accessory designs magnetically adhere in a predetermined location on the planar magnetic design sheets of human figure designs to create a predetermined design. The magnetic base sheet has a background image complementing the planar magnetic design sheets of human figure designs.

Furthermore, the bottom layer of the planar magnetic design sheets may be composed of a mixture of strontium and barium ferrites, the top layer of the planar magnetic design sheets may be polyvinyl chloride, and the middle layer of the planar magnetic design sheets may be synthetic rubber. The planar magnetic design sheets may be from 0.4 mm to 0.6 mm thick and the base sheet may be from 0.4 mm to 0.6 mm thick. Alternatively, in this embodiment, the base sheet may be constructed from a magnetic powder mixed with polymers and the magnetic base sheet is an isotropic magnet. Furthermore, the planar magnetic design sheets have an intrinsic coercivity of 3100 Oe to 3600 Oe, a coercivity of 1900 Oe to 2200 Oe, a remanence of 2100 to 2600, a maximum energy product of 1.10 MGOe to 1.30 MGOe, and a magnetic pull force of 42 Newtons. Also, the magnetic powders in the base sheet may be a mixture of strontium and barium ferrite.

This alternative embodiment of the toy set may further comprise a plurality of coloring instruments. In this embodiment the surface of the planar magnetic designs may be colored with the coloring instruments to enhance the design on the surface of the planar magnetic design sheets. Furthermore, in this embodiment of the invention, the bottom layer of the planar magnetic design sheets may be composed of a mixture of strontium and barium ferrites, the top layer of the planar magnetic design sheets may be polyvinyl chloride, and the middle layer of the planar magnetic design sheets may be synthetic rubber.

In an alternative embodiment of the invention the invention is directed toward toward a stackable magnetic toy set comprising a plurality of planar magnetic design sheets and a magnetic base sheet. Each of the planar magnetic design sheets are comprised of a bottom layer of magnetic foil, a middle layer of an acrylic elastomer, and a top layer of a printable thermoplastic. The planar magnetic design sheets are anisotropic magnets consisting of a series of alternating strips of polarity. The alternating strips of polarity of one planar magnetic design sheet are structured to magnetically attach to the alternating strips of polarity of a complementary planar magnetic design sheet. The planar magnetic design sheet and the complementary magnetic design sheet form a predetermined image when magnetically adhered together. The magnetic base sheet is comprised of a thermoplastic bonded metallic foil. The plurality of planar magnetic design sheets are stacked together on top of the magnetic base sheet to create a predetermined design. The plurality of planar magnetic design sheets are combined edge to edge to create a predetermined design. In this embodiment the planar magnetic design sheets and base sheet are designed to permit a user to place the planar magnetic design sheets in a printer to print a personal design on the planar magnetic design sheets or base sheet.

DETAILED DESCRIPTION OF THE DRAWINGS

Figure 1:
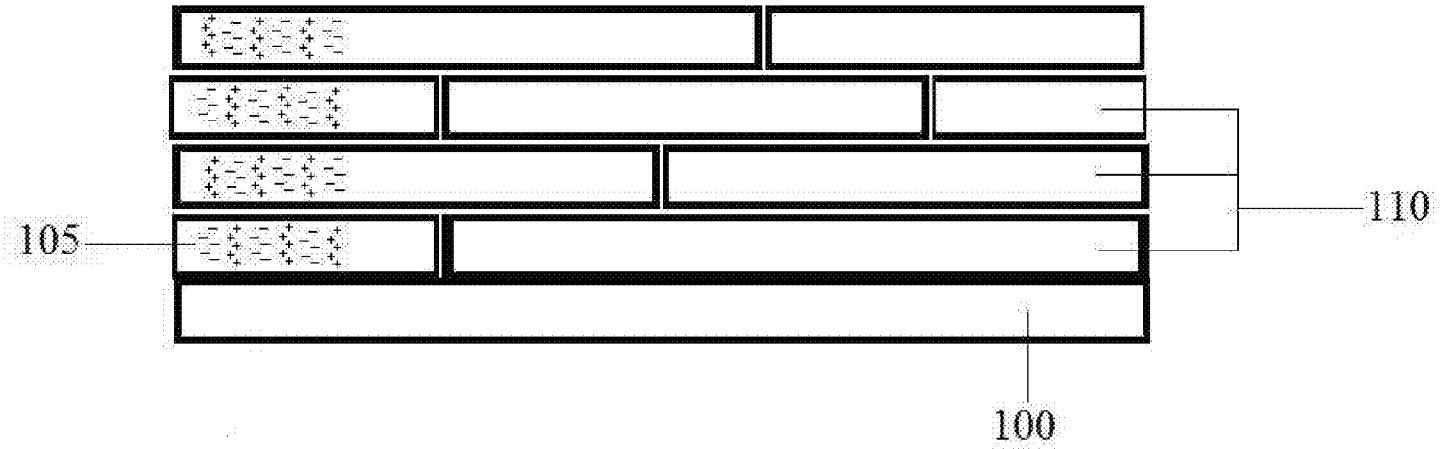
FIG. 1 is a side view of the magnetic sheets

Although the present invention will be described with reference to the exemplary embodiments shown in the drawings, it should be understood that the present invention can be embodied in many alternate forms or embodiments.

Referring to FIG. 1, the side view of the invention is displayed. The invention utilizes a magnetic base sheet 100 and a plurality of magnetic design sheets 110. The magnetic base sheet 100 is approximately 0.6 mm in thickness. The magnetic base sheet 100 is a flexible, thermoplastic bonded metallic foil embedded with strontium or barium ferrite powder. In this embodiment, the magnetic base sheet 100 is an isotropic magnetic material. In another embodiment, the magnetic base sheet 100 may be a thermoplastic bonded metallic foil without any embedded magnetic particles. In this embodiment the metallic foil contains iron for the purposes of maintaining attraction to the magnetic design sheets 110. The thermoplastic may be any type of commercially utilized thermoplastic. In the preferred embodiment the thermoplastic is polyvinylchloride (PVC) or polyethylene (PET). The magnetic base sheet 100 may have any design printed or displayed on the thermoplastic surface.

In the preferred embodiment, the magnetic design sheets 110 are comprised of approximately 89% by weight of a mixture of strontium and barium ferrites. The remaining 11% by weight is comprised of chlorinated polyethylene and plasticizers. In other embodiments, the magnetic design sheets 110 may have any other type of rare earth component to provide for the magnetic properties of the magnetic design sheets 110. The magnetic design sheets 110 have a surface of thermoplastic. In the preferred embodiment the surface of the magnetic design sheets 110 is polyvinylchloride (PVC). Between the PVC surface and the strontium and barium ferrite is a layer of acrylic elastomers. In the preferred embodiment the acrylic elastomer is in the form of synthetic rubber. The magnetic design sheets 110 may have any design printed or displayed on the thermoplastic surface. The magnetic material in the magnetic design sheets 110 is an anisotropic magnetic material. The magnetic poles in the magnetic design sheets 110 are oriented in alternating strips 205 running the length of the magnetic design sheets 110. The alternating strips 205 are approximately 2.5 mm wide. In this manner, one magnetic design sheet 110 consists of a series of alternating strips 205 that alternate in polarity from positive to negative and negative to positive. The alternating strips 205 of one magnetic design sheet 110 are designed to align with the opposite polarity alternating strips 205 of another magnetic design sheet 110. In this manner the magnetic design sheets 110 are stackable in predetermined positions and orders. As such, the magnetic design sheets 110 can create a three dimensional puzzle or design.

In the preferred embodiment, the magnetic design sheets 110 have a magnetic pull force of 42 Newtons. In the preferred embodiment, the magnetic design sheets 110 have an intrinsic coercivity of 3100 Oe to 3600 Oe, a coercivity of 1900 Oe to 2200 Oe, a remanence of 2100 to 2600, and a maximum energy product of 1.10 MGOe to 1.30 MGOe. In other embodiments, the magnetic design sheets 110 may have other magnetic properties.

Figure 2:
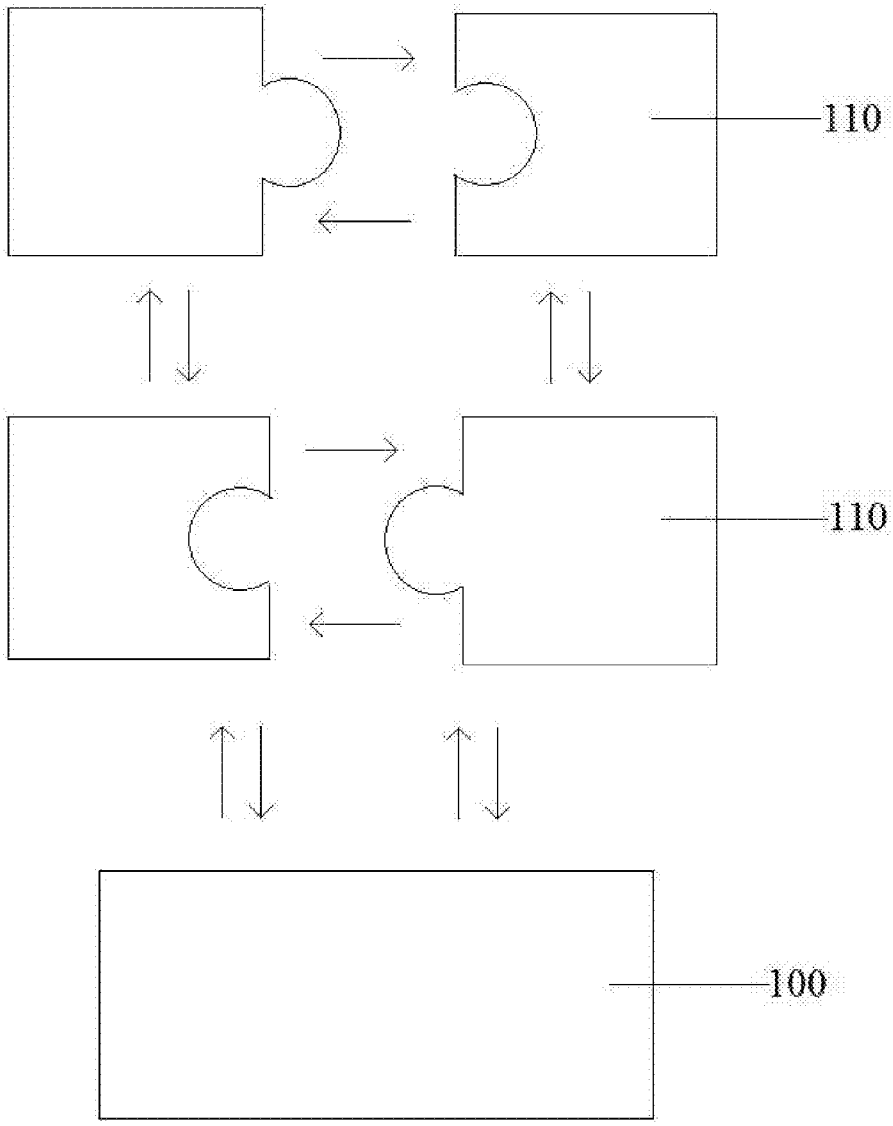
FIG. 2 is a view of the connected

As displayed in FIG. 2, the magnetic design sheets 110 may take specific shapes that permit the magnetic design sheets 110 to combine together side-by-side in a predetermined pattern such as puzzle pieces. The magnetic design sheets 110 connect or position together in a predetermined planar formation, which may then stack on top of another predetermined magnetic planar formation of magnetic design sheets 110. The magnetic design sheets 110 in one predetermined planar formation may physically connect together. Alternatively, the magnetic design sheets 110 in one predetermined planar formation may not physically connect together with the other magnetic design sheets 110 but abut edge to edge in a predetermined formation in a single plane. One plane of magnetic design sheets 110 then magnetically attaches in a specific location and pattern one top of another plane of magnetic design sheets 110.

The magnetic design sheets 110 and magnetic base sheet 100 are structured such that a user may place the magnetic design sheets or magnetic base sheet 100 in a personal printer and print a personal design image on the magnetic design sheets 110 and magnetic base sheet 100. In one embodiment the magnetic base sheet 100 has a peel and stick backing which allows a user to attach the magnetic base sheet 100 to a wall or other nonmagnetic vertical surface by means of an adhesive which is preapplied to the back of the magnetic base sheet 100.

Figure 3:
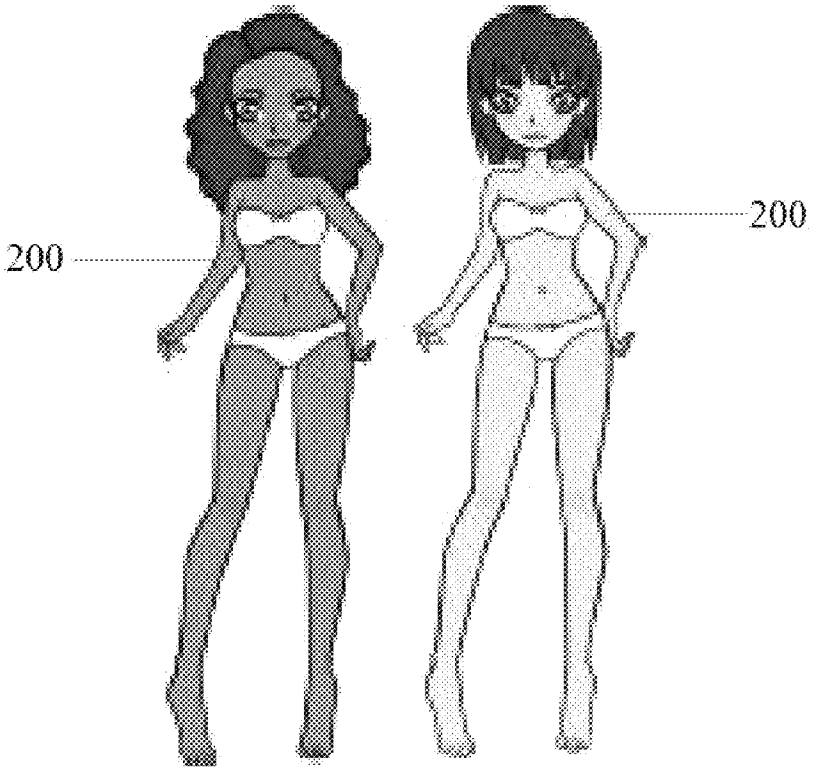
FIG. 3 is a view of the magnetized dolls.

As shown in FIG. 3, in one embodiment of the invention, the magnetic design sheets 110 are in the form of magnetized dolls 200. The magnetized dolls 200 may be composed of one magnetic design sheet 110, or a combination of magnetic design sheets 110 in a single predetermined planar formation.

FIG. 3 displays two of the magnetized dolls 200 displaying animate figure designs. The magnetized dolls 200 may take any form which resembles a living figure. In the preferred embodiment the magnetized dolls 200 display female human designs. In other embodiments, the magnetized dolls 200 may also display designs of male humans, animals, pets, fish, plants, or any other type of a living figure.

Figure 4:
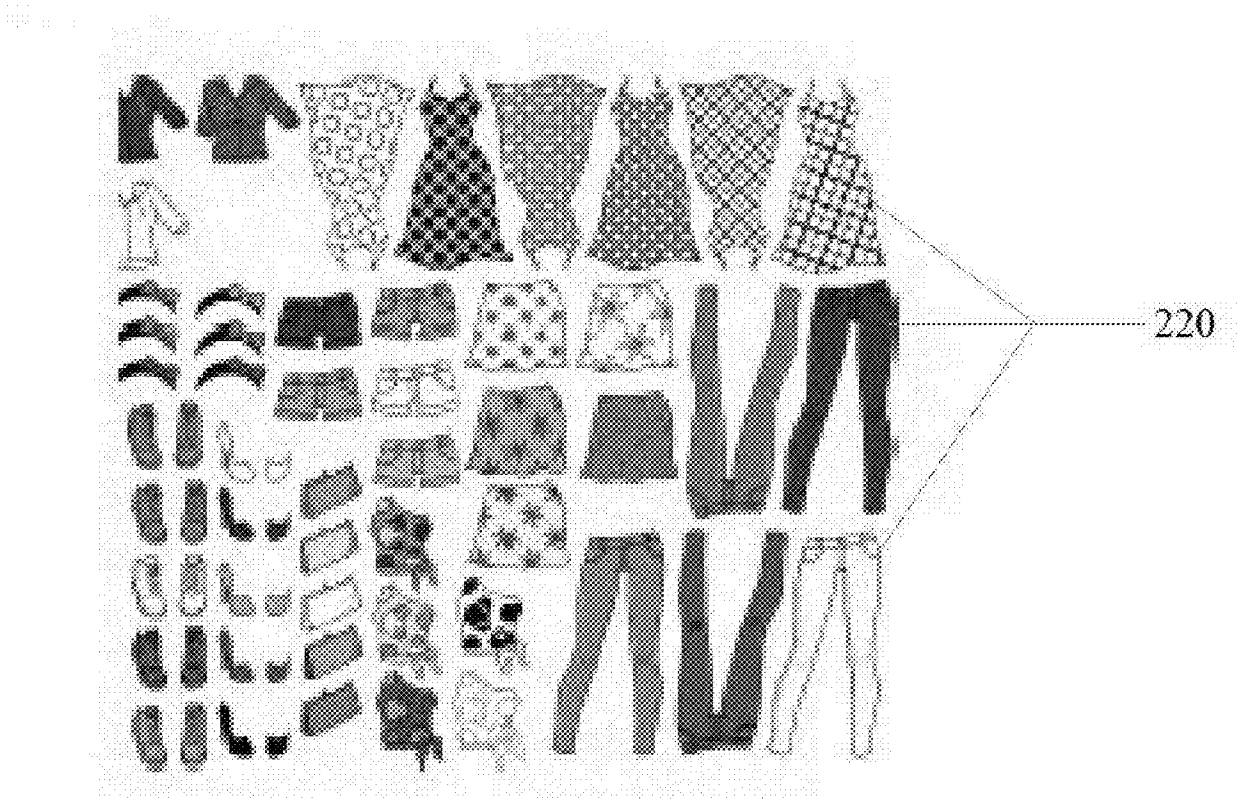
FIG. 4 is a view of the magnetized doll accessories.

As shown in FIG. 4, the magnetized design sheets 110 may also take the form of magnetized doll accessories 220. The magnetized doll accessories 220 may be composed of one magnetic design sheet 110, or a combination of magnetic design sheets 110 in a single predetermined planar formation. The magnetized doll accessories 220 are of various shapes and sizes. The magnetized doll accessories 220 each bear the design of an inanimate object. The magnetized doll accessories 220 are intended to be placed on top of the magnetized dolls 200. The magnetized doll accessories 220 bear images of clothing, shoes, purses, and other items which would naturally complement the design image appearing on the magnetized dolls 200. When the magnetized doll accessories 220 are placed on top of the magnetize dolls 200, the visual effect is that the magnetized dolls 200 appear to be clothed. When playing with the magnetized dolls 200, a child may use multiple magnetized doll accessories 220 on top of the magnetized dolls 200. A child may also place magnetized doll accessories 220 on top of other magnetized doll accessories 220 which have been placed on the magnetized dolls 200. A child may change the magnetized doll accessories 220 that are placed on the magnetized doll 200, effectively creating the effect that the child is changing the clothing of the magnetized doll 200. Any number of magnetized doll accessories 220 may be used, in any combination, allowing a child to create different clothing designs and combinations on the magnetized doll 200.

Figure 5:
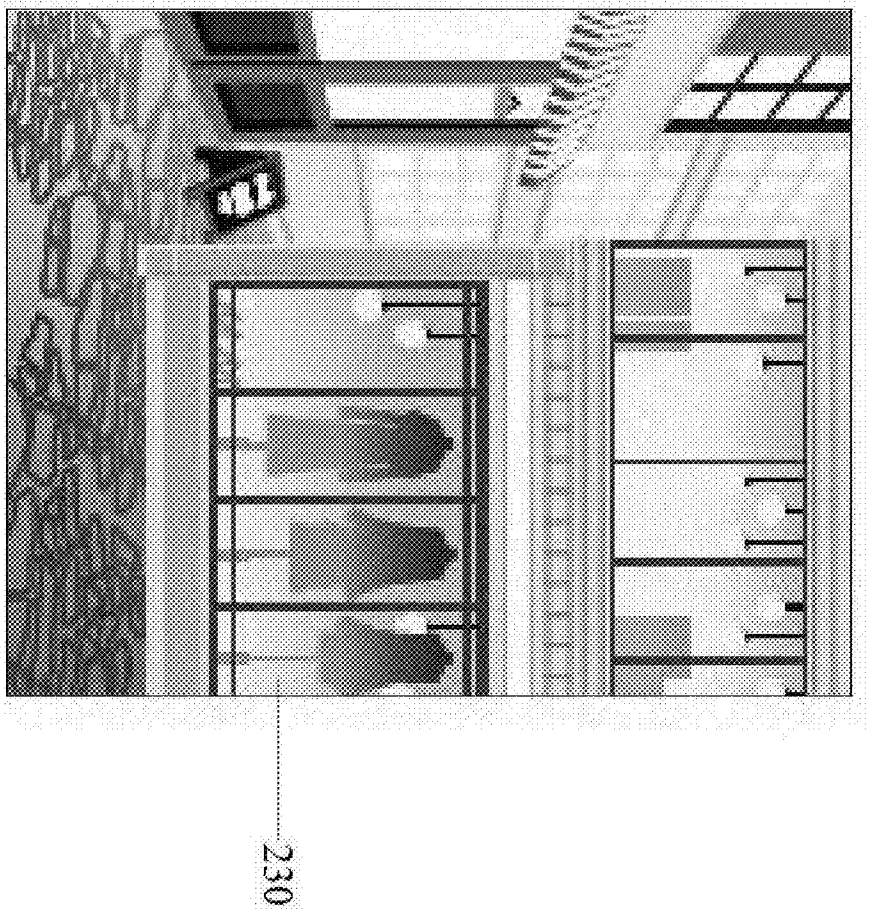
FIG. 5 is a view of the magnetized backdrop.

As shown in FIG. 5, the magnetic base sheet 100 may have a background design image 230 to be utilized in association with the magnetized dolls 200 or the magnetized doll accessories 220. The background design image 230 displays a design image of a setting or background on which to place the magnetized doll 200. The background design image 230 may display any image or design which would operate as a setting or background for a doll. When playing with the magnetized doll 200, a child may place the magnetized doll on the magnetized background sheet 230 in any place on the background design image 230. A child may also place a multitude of magnetized doll accessories 220 on the magnetized doll 200 when the magnetized doll 200 is placed on the background design image 230.

Figure 6:
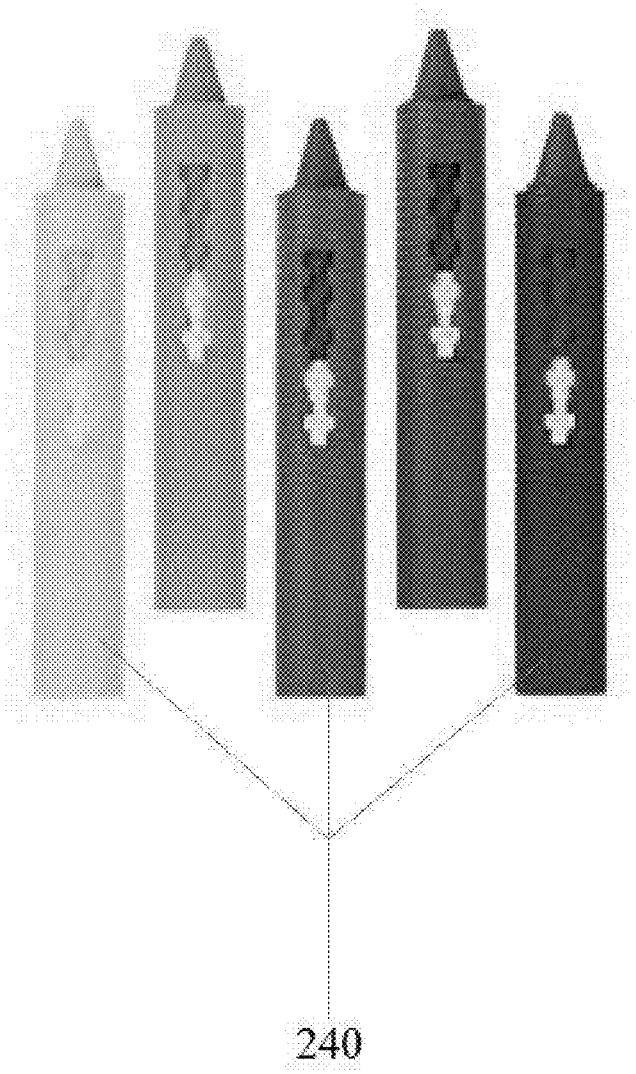
FIG. 6 is a view of the washable crayons.
Figure 7:
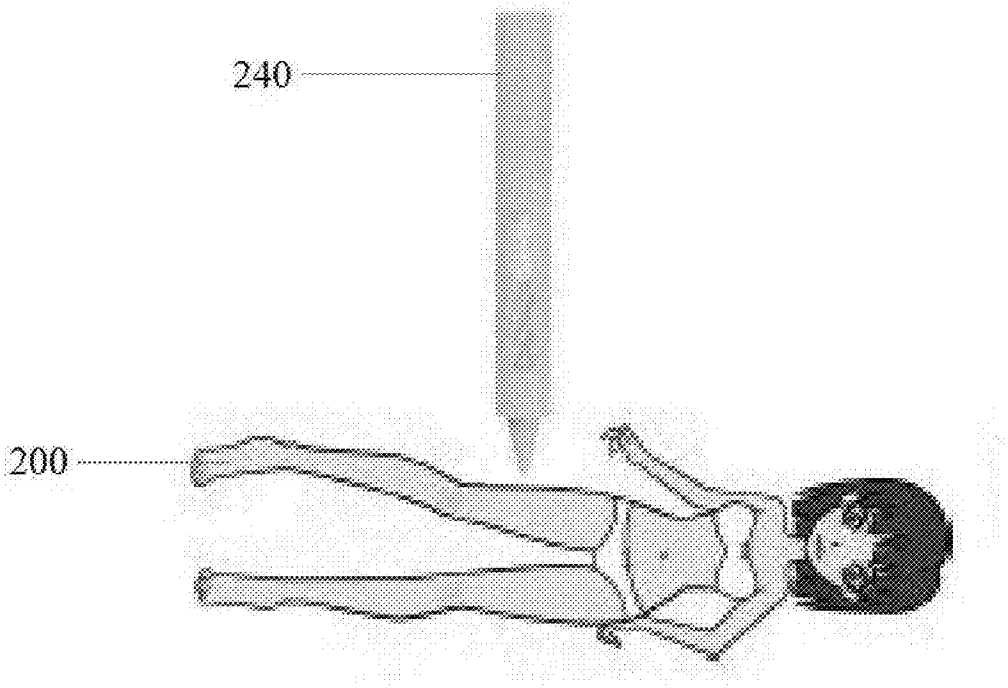
FIG. 7 is a view of process of using the washable crayons.

As shown in FIG. 6, one embodiment of the invention utilizes temporary coloring implements 240. In the preferred embodiment of the invention, the temporary coloring implements 240 are washable crayons. The temporary coloring implements 240 may also be markers, pencils, or any other standard coloring device which may be used and then erased as desired. Referring to FIG. 7, a child uses the temporary coloring implements 240 to color the face and design of any of the magnetic dolls 200. The child may also use the temporary coloring implements 240 to color the face and design of the magnetic doll accessories 220 or background design image 230. The temporary coloring implements 240 apply a temporary color to the magnetic dolls 200, magnetic doll accessories 220, or background design image 230. The child may use a cloth, with or without soap and water, to remove the color from the magnetic dolls 200, magnetic doll accessories 220, or background design image 230. Once clear, the child may use the temporary coloring implements 240 to color the magnetic dolls 200, magnetic doll accessories 220, or background design image 230 again.

Figure 8:
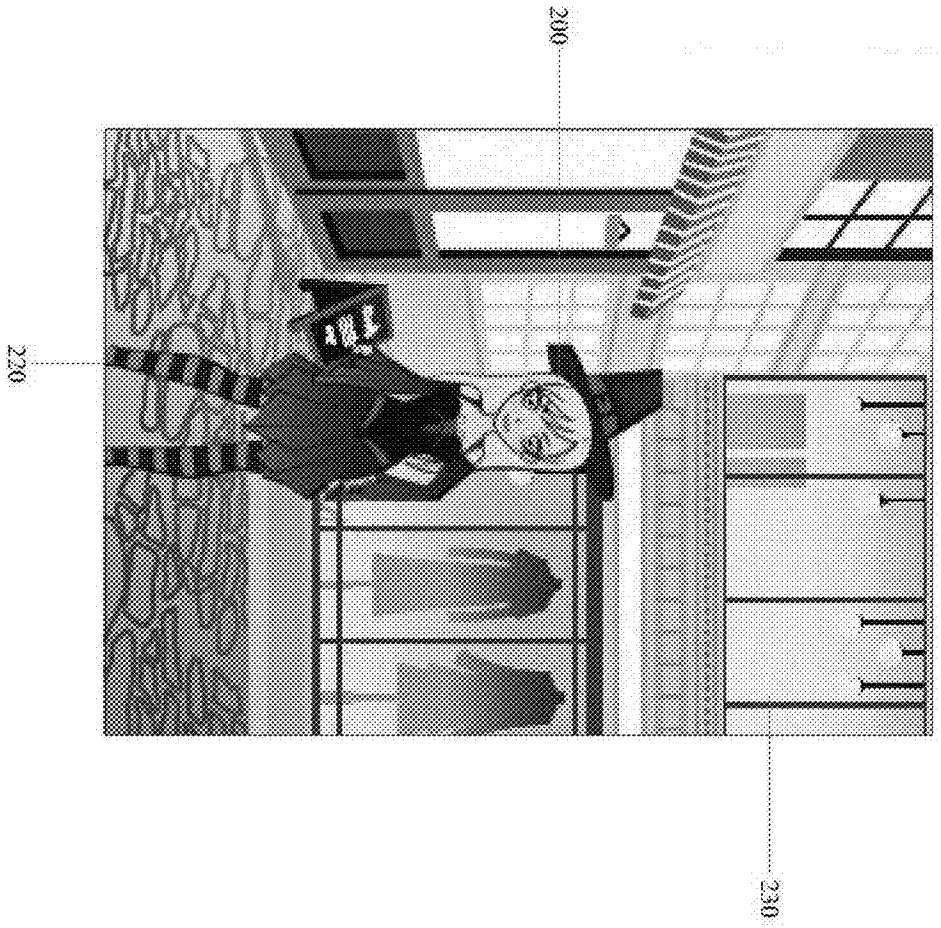
FIG. 8 is a general view of the invention.

Referring to FIG. 8, the combined set of the invention is displayed. The magnetized doll 200 is placed on the background design image 230. On top of the magnetized doll 200 are placed magnetized doll accessories 220. The combined effect is to create the image of a clothed person in a setting, creating an image created by the child.

The invention claimed is:

1. A stackable magnetic toy set comprising
a plurality of planar magnetic design sheets
wherein each of said planar magnetic design sheets is comprised of a bottom layer of magnetic foil, a middle layer of an acrylic elastomer, and a top layer of a printable thermoplastic
an anisotropic magnet
the planar magnetic design sheets consist of a series of alternating strips of polarity
wherein said alternating strips of polarity of one planar magnetic design sheet is structured to magnetically attach to the alternating strips of polarity of a complementary planar magnetic design sheet
wherein said planar magnetic design sheet and said complementary magnetic design sheet form a predetermined image when magnetically adhered together
a magnetic base sheet
wherein said magnetic base sheet is comprised of a thermoplastic bonded metallic foil
wherein said plurality of planar magnetic design sheets are stacked together on top of said magnetic base sheet to create a predetermined design
wherein said plurality of planar magnetic design sheets are combined edge to edge to create a predetermined design.

2. The toy set as in claim 1
wherein said bottom layer of said planar magnetic design sheets is composed of a mixture of strontium and barium ferrites
wherein said top layer of said planar magnetic design sheets is polyvinyl chloride
wherein said middle layer of said planar magnetic design sheets is synthetic rubber.

3. The toy set as in claim 2
wherein said planar magnetic design sheets are 0.4 mm to 0.6 mm thick
wherein said base sheet is 0.4 mm to 0.6 mm thick.

4. The toy set as in claim 3
wherein said base sheet is constructed from a magnetic powder mixed with polymers
wherein said magnetic base sheet is an isotropic magnet.

5. The toy set as in claim 4
wherein said planar magnetic design sheets have an intrinsic coercivity of 3100 Oe to 3600 Oe, a coercivity of 1900 Oe to 2200 Oe, a remanence of 2100 to 2600, a maximum energy product of 1.10 MGOe to 1.30 MGOe, and a magnetic pull force of 42 Newtons
wherein said magnetic powders in said base sheet is a mixture of strontium and barium ferrite.

6. The toy set as in claim 5 in further comprising
a plurality of coloring instruments
wherein the surface of said planar magnetic designs may be colored with said coloring instruments to enhance the design on the surface of said planar magnetic design sheets.

7. The toy set as in claim 6
wherein said coloring instruments are washable crayons.

8. The toy set as in claim 6
wherein said coloring instruments are washable markers.

9. The toy set as in claim 6
wherein said coloring instruments are paint brushes with a plurality of water-based paints.

10. The toy set as in claim 6
wherein said planar magnetic design sheets consist of human figure designs and human figure accessory designs
wherein said planar magnetic design sheets of human figure accessory designs magnetically adhere in a predetermined location on said planar magnetic design sheets of human figure designs to create a predetermined design
wherein said magnetic base sheet has a background image complementing said planar magnetic design sheets of human figure designs.

11. The toy set as in claim 10
wherein said base sheet further comprises a peel and stick back
said base sheet having a pre-applied adhesive on the back of said base sheet permitting a user to removably adhere said base sheet to a vertical surface area.

12. The toy set as in claim 11
wherein said planar magnetic design sheets are designed to permit a user to place said planar magnetic design sheets in a printer to print a personal design on said planar magnetic design sheets
wherein said base sheet is designed to permit a user to place said base sheet in a personal printer to print a personal design on said base sheet.

13. The toy set as in claim 1
wherein said planar magnetic design sheets consist of human figure designs and human figure accessory designs
wherein said planar magnetic design sheets of human figure accessory designs magnetically adhere in a predetermined location on said planar magnetic design sheets of human figure designs to create a predetermined design
wherein said magnetic base sheet has a background image complementing said planar magnetic design sheets of human figure designs.

14. The toy set as in claim 13
wherein said bottom layer of said planar magnetic design sheets is composed of a mixture of strontium and barium ferrites
wherein said top layer of said planar magnetic design sheets is polyvinyl chloride
wherein said middle layer of said planar magnetic design sheets is synthetic rubber.

15. The toy set as in claim 14
wherein said planar magnetic design sheets are 0.4 mm to 0.6 mm thick
wherein said base sheet is 0.4 mm to 0.6 mm thick.

16. The toy set as in claim 15
wherein said base sheet is constructed from a magnetic powder mixed with polymers
wherein said magnetic base sheet is an isotropic magnet.

17. The toy set as in claim 16
wherein said planar magnetic design sheets have an intrinsic coercivity of 3100 Oe to 3600 Oe, a coercivity of 1900 Oe to 2200 Oe, a remanence of 2100 to 2600, a maximum energy product of 1.10 MGOe to 1.30 MGOe, and a magnetic pull force of 42 Newtons
wherein said magnetic powders in said base sheet is a mixture of strontium and barium ferrite.

18. The toy set as in claim 13 further comprising a plurality of coloring instruments wherein the surface of said planar magnetic designs may be colored with said coloring instruments to enhance the design on the surface of said planar magnetic design sheets.

19. The toy set as in claim 18 wherein said bottom layer of said planar magnetic design sheets is composed of a mixture of strontium and barium ferrites wherein said top layer of said planar magnetic design sheets is polyvinyl chloride wherein said middle layer of said planar magnetic design sheets is synthetic rubber.

20. The toy set as in claim 1 wherein said planar magnetic design sheets are designed to permit a user to place said planar magnetic design sheets in a printer to print a personal design on said planar magnetic design sheets wherein said base sheet is designed to permit a user to place said base sheet in a personal printer to print a personal design on said base sheet.

* * * * *